United States Patent [19]

Maximov

[11] 4,391,431

[45] Jul. 5, 1983

[54] DEVICE FOR TIGHTENING COARSE THREAD CONNECTIONS

[76] Inventor: July S. Maximov, ulitsa Lesnaya, 52, kv. 8, Moskovskaya oblast, poselok Pravda, U.S.S.R.

[21] Appl. No.: 243,901

[22] PCT Filed: Oct. 29, 1979

[86] PCT No.: PCT/SU79/00102

§ 371 Date: Feb. 23, 1981

§ 102(e) Date: Feb. 23, 1981

[87] PCT Pub. No.: WO81/00075

PCT Pub. Date: Jan. 22, 1981

[30] Foreign Application Priority Data

Jun. 27, 1979 [SU] U.S.S.R. ..... 2785072

[51] Int. Cl.[3] ..... E21B 19/00

[52] U.S. Cl. ..... 254/29 A

[58] Field of Search ..... 254/29 A, 104; 81/57, 81/38; 29/452

[56] References Cited

U.S. PATENT DOCUMENTS 3,285,568 11/1966 Biach .
3,749,362 7/1973 O'Connor .
3,774,352 11/1973 Weber ..... 254/104
4,010,669 3/1977 Kloren .
4,104,934 8/1978 Raschke et al. .

FOREIGN PATENT DOCUMENTS 2238974 12/1974 Fed. Rep. of Germany .
2611237 9/1977 Fed. Rep. of Germany .
258157 5/1968 U.S.S.R. .
344980 7/1972 U.S.S.R. .

*Primary Examiner*—Robert C. Watson
*Attorney, Agent, or Firm*—Fleit, Jacobson & Cohn

[57] ABSTRACT

A device for tightening coarse thread connections comprises a pressure element (1), a tension element (2) and a power wedge (3) having a screw drive. Provided in the tension element (2) is a wedge groove (10), whereas the pressure element (1) has arranged essentially coaxially with the wedge groove (10) through grooves (13), the power wedge (3) passing through the grooves (10 and 13). The pressure element (1) is in the form of a hollow body accommodating the tension element (2) carrying rotatably secured thereto a connecting piece (16) having a threaded bore (17) for fastening with a threaded connectable piece. Apertures (22) are provided in the pressure element (1) in the area adjoining the connecting piece (16). Walls of the through grooves (13) of the pressure element (1) define a guide receiving straight working surface (12) of the power wedge (3).

16 Claims, 9 Drawing Figures

DEVICE FOR TIGHTENING COARSE THREAD CONNECTIONS

TECHNICAL FIELD

The present invention relates to bolt and flange connections, and more particularly to devices for tightening coarse thread connections of from 30 mm in diameter which can be used in various branches of the industry.

BACKGROUND ART

To date, wide utilization in tightening coarse thread connections have found numerous means and devices ranging from simple wrenches and power drive bolt tightening machines to cranes or derricks.

For tightening a threaded connection use is generally made of prestraining of a threaded piece, such as a stud piece, of the connection by means of a hydraulic jack or by heating thereof with consequent screwing the nuts. However, the above means and machines lack convenience in operation, are cumbersome and require the use of additional equipment to be employed in conjunction with such hydraulic jacks or for preheating of the threaded piece of the connection.

Known in the art are devices for tightening coarse thread connections as exemplified in USSR Inventors' Certificates Nos. 258,157 and 344,980; Cl. B 25 b 29/02, published Nov. 20, 1969 and July 14, 1972 respectively.

Either of the above devices comprises a pressure element adapted to thrust against one of the pieces to be connected, a tension element having a wedge groove accommodating a power wedge intended to act upon the pressure element to produce strain in the threaded piece, such as a fastening bolt or a stud. The power wedge is a one-way action type, that is one working surface thereof is straight or vertical, whereas another one is inclined, the angle of inclination between the surfaces ranging between 1° and 7° depending on the required operational parameters.

The power wedge is essentially of a rectangular cross-section with side or non-working surfaces thereof being straight or vertical. A screw drive is employed to effect displacement of the power wedge along the groove of the tension element, the screw drive being disposed in the tension element. The tension element is made integral with a head of the fastening bolt. In order to form the wedge groove, wherein the power wedge moves, the pressure element is provided with an inclined surface and accommodated in the groove of the tension element, the inclined surface of the power wedge cooperating with the inclined surface of the pressure element.

The aforedescribed devices afford to produce, at high torques exerted to the nut of the fastening bolt and therefore at high axial loads, the same value of the axial load with dozens of times lesser torques applied, which is to some extent advantageous in operation. However, these devices can only be used as stationary devices, that is they must be provided at every fastening bolt to be tightened. Accordingly, they are preferably to be used in conjunction with flange connections or couplings which are subject to frequent dismantling, such as those dismantled several times within one week.

The use of the above devices for flange connections which are not subject to frequent disassembling is economically unjustified, since each fastening bolt should be provided with such ancillaries as a wedge, screw, pressure element and other extra parts. Also, these devices fail to effect repeated tightening of a threaded connection with a view to attain a rated load to be exerted to a bolt or stud.

Further known is a detachable means for tightening threaded connections which can be removed from one tightened connection to be used for tightening another connection (cf. Patent of Germany, Federal Republic of, No. 2,238,974; Cl. B 25 B 23/14, published Dec. 12, 1974). A pressure element in this device is fashioned as a body embracing both a tension element and a nut of a stud piece to be connected. For imparting tension to the stud piece use is made here of an eccentric shaft acting through a sleeve member on the tension element and exerting pressure against the pressure element through rollers. Also, there is provided a lever or bar secured to a square head at the ends of the eccentric shaft. This device, however, can be used only with threaded connections of one size. In addition, for fastening, i.e. screwing, the tension element to the end of the piece to be tightened it is necessary to rotate the whole device together with the eccentric shaft and lever which to some extent limits the range of application of the device, since sufficient room must be available around the piece to be tightened. Further, the eccentric shaft creates considerable specific pressures on the cooperating surfaces, which results in undue wear thereof and leads to an increase in the value of torque applied thereto.

Employment in the heretofore described device of a mechanism other than the eccentric shaft, for example, of a wedge driven by a screw, will fail to expand the range of application or the operating principle thereof.

DISCLOSURE OF THE INVENTION

It is an object of the present invention to provide a device for tightening coarse thread connections having such a structural arrangement of pressure and tension elements as to afford employment thereof with connections having various thread diameters and prevent axial rotation thereof in the course of fastening the device to a threaded piece to be connected thereby facilitating convenience in operation.

This object is attained by that in a device for tightening coarse thread connections comprising a pressure element thrusting against one of connectable pieces, and a tension element secured on the threaded piece and having a wedge groove wherein there is disposed a power wedge imparting pressure to the pressure element and producing tension in the threaded connectable piece, a screw drive of the power wedge being accommodated on the pressure element, according to the invention, the pressure element is fashioned as a hollow body provided with through grooves therein and accommodating the tension element carrying a rotatable connecting piece having a threaded axial bore for securing this connecting piece to the threaded piece of the connection, the pressure element being provided in the area thereof adjoining the connecting piece with apertures, the walls of the through grooves being disposed coaxially with the wedge groove of the tension element to define a guide receiving the straight surface of the power wedge.

Positioning of the tension element and the connecting piece inside the pressure element having through grooves arranged essentially coaxially with the wedge groove makes the device structurally compact, as well as helps reduce the overall dimensions and weight thereof and enables normal operation of the power wedge to thereby obtain thrust efforts of greater magnitude between the pressure and tension elements at normal allowable specific pressures exerted against the bearing surfaces.

Further, the provision of the connecting piece on the tension element for free axial rotation and the provision of the through bore in the connecting piece for fastening thereof to the threaded piece affords to connect the threaded piece with the tension element without rotating the whole device and makes it possible to mount the device in operable position regardless of the amount of free space available in the area of the threaded connection. This can be done by virtue of the apertures arranged in the pressure element in the area adjoining the connecting piece, the apertures affording an access to the connecting piece for screwing thereof onto the threaded piece of the connection.

For tightening the threaded connection of a different size, the connecting piece of the tension element is replaced by a different connecting piece having an axial bore essentially conforming to the diameter of the threaded piece to be tightened.

Preferably, the axial bore of the connecting piece is provided with a replaceable threaded sleeve, while the connecting piece has drillings arranged at the outer surface thereof. A change of the threaded sleeve thereby enables to use the device for tightening pieces with various thread types, otherwise to provide for a versatile application of the device.

According to another aspect of the invention, the tightening device has at least one intermediate sleeve member disposed after screwing it onto the threaded piece in the axial bore of the connecting piece of the tension element and secured therein by means of a bayonet joint, the intermediate sleeve member having a cylindrically shaped axial end piece and a projection or head to fit a wrench, whereas the connecting piece of the tension element is provided with an axial bore to receive the end piece of the intermediate sleeve member and a lever passing through the aperture provided in the pressure element. This enables to operatively and reliably couple the device with the threaded piece of the connection. In addition, such an arrangement of the device for tightening coarse thread connections allows for a set of intermediate sleeves to be screwed onto threaded pieces prior to tightening, which in turn helps materially increase the productivity of asembling or disassembling the threaded connections.

According to still another aspect of the invention, the device provides for an insert to placed between the tension and pressure elements essentially in the area adjoining the power wedge, the insert acting to eliminate possible skewness or misalignments between the pressure and tension elements in the course of progressive motion of the power wedge, which results in lesser force exerted on the screw bolt of the screw drive.

Further, inserts are also provided in the wedge groove of the tension element and the through grooves of the pressure element arranged coaxially relative to the wedge groove, which results in an increased efficiency of the power wedge. It is advisable that the surfaces of the inserts cooperating with the surfaces of the power wedge be formed by needle rollers to substitute sliding friction for rolling friction and thereby improve the operating efficiency of the device.

According to yet another aspect of the invention, the pressure element is made up of two parts interconnected threadingly therebetween. This allows to use the herein proposed device for tightening connections with various lengths of the ends of threaded pieces protruding from the nuts to be tightened, the connecting piece of the device being screwed onto said end of the threaded pieces. Thus, by rotating one of the parts of the pressure element, it becomes possible to compensate for the length of the free end of the threaded piece. Therewith, it is preferable that the part of the pressure element thrusting against one of the connectable pieces be in the form of a spherical abutment with the center of the sphere lying essentially on the common center line of the connecting piece and the threaded piece, as a result of which it is possible to tighten threaded connections even when the center line or axis of the threaded piece and the thrust surface of the connection are not in a perpendicular relation to each other.

The above spherical abutment can possibly be coupled with the pressure element via a resilient spacer member affording for the pressure element to self-adjust during tightening of the threaded connection.

Another feature of the invention resides in that arranged in the power wedge essentially in parallel with the straight working surface thereof is a through bore, the screw bolt of the screw drive being accommodated in this through bore and provided with a ball bearing screw nut, a thrust assembly of the screw bolt resting on a self-adjusting center plate.

The positioning of the screw bolt in the through bore of the power wedge helps reduce overall dimensions and weight of the device, whereas the provision of the ball bearing screw nut enables to considerably improve the operating efficiency of the device to thereby use less effort for tightening the threaded connections. Also, the employment of the screw bolt thrust assembly provided with the self-adjusting center plate permits to eliminate possible misalignments between the screw, wedge and pressure element which may occur during the assembly and manufacture thereof, thus resulting in a simpler production process employed and reduced cost price of the device.

Further aspects of the invention reside in that the pressure element is spring-urged against the power wedge thereby enabling a constant pressure contact between the pressure and tension elements via the power wedge, preventing the needle rollers from falling out from the inserts during inoperative position of the device and affording a required gap between the tension element and the straight working surface of the wedge, which gap is taken in or reduced in the course of tightening the threaded connection.

Having in view the foregoing, the herein proposed device for tightening coarse thread connections enables to reduce the amount of torque applied 20 to 50 times compared to the rated one, affords to monitor and the forces exerted during tightening of the threaded pieces, such as bolts or studs, and permits to effect repeated straining or stretching of a connectable threaded piece of a connection without any power consumed from external energy sources, such as hydraulic, pneumatic or electric power souces.

Further, the device is versatile in that it can be used for tightening threaded connections of various diameters; it is easy to operate, since it acts by virtue of an effort applied by an operator to the screw of the power wedge drive.

BRIEF DESCRIPTION OF THE DRAWINGS

The invention will now be described in greater detail with reference to specific embodiments of a device for tightening coarse thread connections according to the invention taken in conjunction with the accompanying drawings, in which.

and

Figure 9:
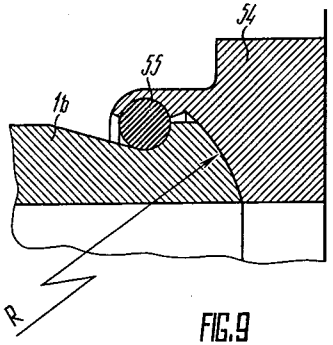
Figure 8:
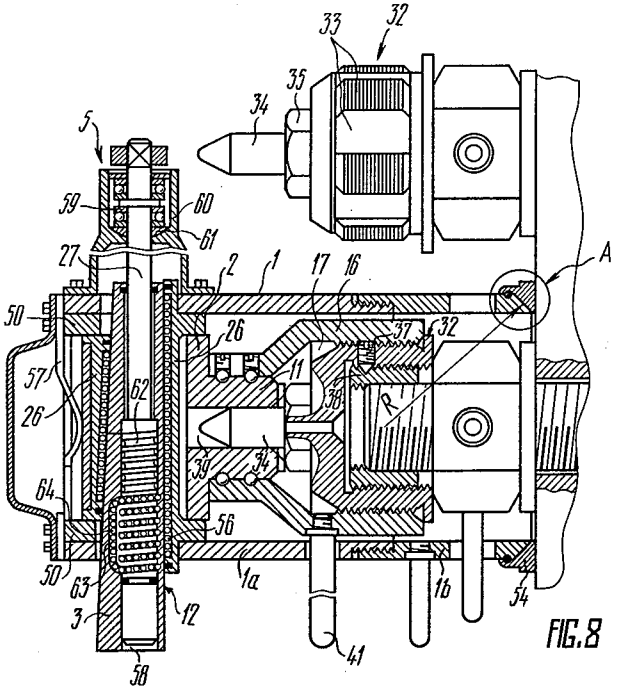
FIG. 8 is a longitudinal sectional view of a modified form of the device according to the invention with a different arrangement of a screw bolt of the screw drive.

FIG. 9 shows an enlarged view of the assembly A of FIG. 8.

BEST MODE OF CARRYING OUT THE INVENTION

Figure 1:
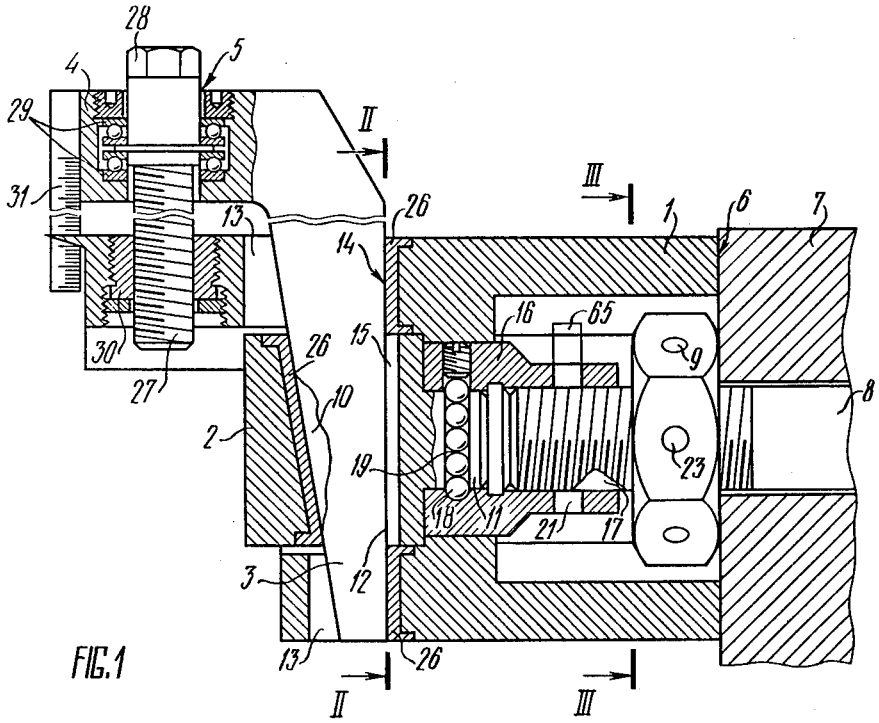
FIG. 1 shows a longitudinal section of a device for tightening coarse thread connections according to the invention.

Referring now to FIG. 1, there is shown a device for tightening coarse thread connections comprising a pressure element 1, a tension element 2, a power wedge 3 with an end piece 4, and a screw drive 5 located on the pressure element 1 and intended to displace the power wedge 3.

The pressure element 1 is in the form of a hollow body having an open end 6 to thrust against the surface of one of connectable pieces 7, such as those of a flange connection, to be drawn together by means of a threaded stud piece 8 provided at the end thereof with a nut 9, the end of the stud 8 being arranged to protrude an essential distance from the nut 9 screwed thereonto. The pressure element 1 is mounted on the workpiece 7 in such a manner that the end of the stud 8 and the nut 9 are inside the hollow or cavity provided therein.

Figure 2:
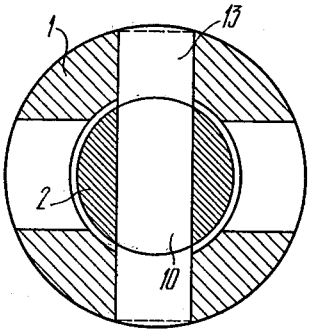
FIG. 2 is a section on the line II—II of FIG. 1.

Accommodated also in the hollow of the pressure element 1 is the tension element 2 intended to be fixed to the end of the stud 8 and provided with a wedge groove 10 and a shank 11, the latter being adapted to face the open end 6 of the pressure element 1. The power wedge 3 is positioned in the wedge groove 10 of the tension element 2, a straight or vertical surface 12 of the power wedge 3 always facing the shank 11 as well as exerting pressure against the pressure element 1 to thereby provide tension or strain in the stud piece 8 by virtue of thrust efforts which appear between the pressure element 1 and the tension element 2. Further provided in the pressure element 1 essentially coaxially with the wedge groove 10 are through grooves 13 (FIG. 2) adapted to receive unobtrusively the power wedge 3 (FIG. 1). Walls 14 of the through grooves 13 which cooperate with the straight or vertical surface 12 of the power wedge 3 therefore define a guide for this wedge when the latter is displaced along the wedge groove 10, which in turn exerts a constant pressure provided by the power wedge 3 and acting against the pressure element 1. A gap or clearance 15 is preset in the wedge groove 10 between the vertical wall thereof and the straight surface 12 of the power wedge 3, the gap being taken in or reduced in the course of progressive displacement of the wedge 3 and stretch deformation of the stud piece 8.

Rotatably mounted on the shank 11 of the tension element 2 is a connecting piece 16 having an axial threaded portion or bore 17 for securing said connecting piece to the end of the stud piece 8, the threads of the axial bore 17 and those of the stud piece 8 being adapted to fit each other.

The connecting piece 16 is secured to the shank 11 by means of a plurality of balls 18 disposed in a grooved portion 19 of the shank 11 and held in place therein by a threaded stop 20 screwed into the grooved portion 19. This arrangement of the connecting piece 16 makes it possible for the latter to freely rotate in the course of it being screwed onto the end of the stud piece 8. Also, the outer surface of the connecting piece 16 is provided with drillings 21, whereas the pressure element 1 has in the area thereof adjacent the connecting piece 16 windows or apertures 22 (FIG. 3), the latter enabling to introduce therethrough tools for screwing the connecting piece 16 onto the end of the stud piece 8. In order to facilitate rotating the nut 9 during tightening the treaded connection, said nut is also provided with drillings 23 (FIG. 1). If for some reason it is difficult to provide the nut 9 with said drillings, a ring fitting (not shown) with drillings can be fitted onto the nut.

To expand the range of technological applications of the herein proposed device, the axial threaded portion 17 (FIG. 4) of the connecting piece 16 can alternatively be provided with a replaceable threaded sleeve member 24 having both an inner threading for being screwed onto the end of the stud piece 8 and an outer threading of a reverse thread direction for being screwed into the connecting piece 16, the sleeve member 24 being held in position in the connecting piece 16 by set screws 25.

In order to reduce friction between the cooperating surfaces of the tension element 2 (FIGS. 1 and 4) and the pressure element 1 and those of the power wedge 3, the wedge groove 10 and the through grooves 13 arranged axially therewith are provided with inserts 26 fabricated from an antifriction material such as bronze.

The screw drive 5 comprises a screw bolt 27 having a head 28 to effect rotation thereof in conjunction with a ratcheted handle or bar.

One end of the screw bolt 27 is accommodated in thrust bearings 29 disposed in a recess of the end piece 4 of the power wedge 3, another end thereof being screwed into a bushing 30 which in turn is threadingly secured in a through threaded opening provided in the pressure element 1. Arranged between the end piece 4 of the power wedge 3 and the pressure element 1 is a strain gauge 31 enabling to visually monitor the extent of strain or tension loads applied longitudinally of the stud piece 8.

For more efficient tightening threaded connections of varying thread diameters, the device according to the invention may be provided with a set of intermediate threaded sleeve 32 (FIGS. 5 and 6) which prior to mounting the device are screwed onto the stud piece 8. After tightening one fastening piece of the connection the device is mounted on another fastening piece already having the intermediate sleeve screwed thereonto to be followed by again tightening this latter piece, whereupon the device is removed therefrom and mounted on a next piece to be tightened. Therewith, the intermediate sleeve 32 is also removed to be screwed onto a subsequent piece to be tightened.

Figure 5:
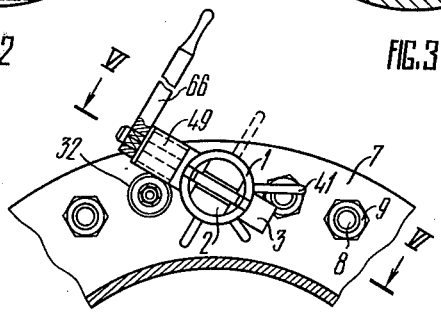
FIG. 5 shows a general view of the device according to the invention disposed on a threaded piece of a flange connection and used in conjunction with intermediate sleeves.
Figure 4:
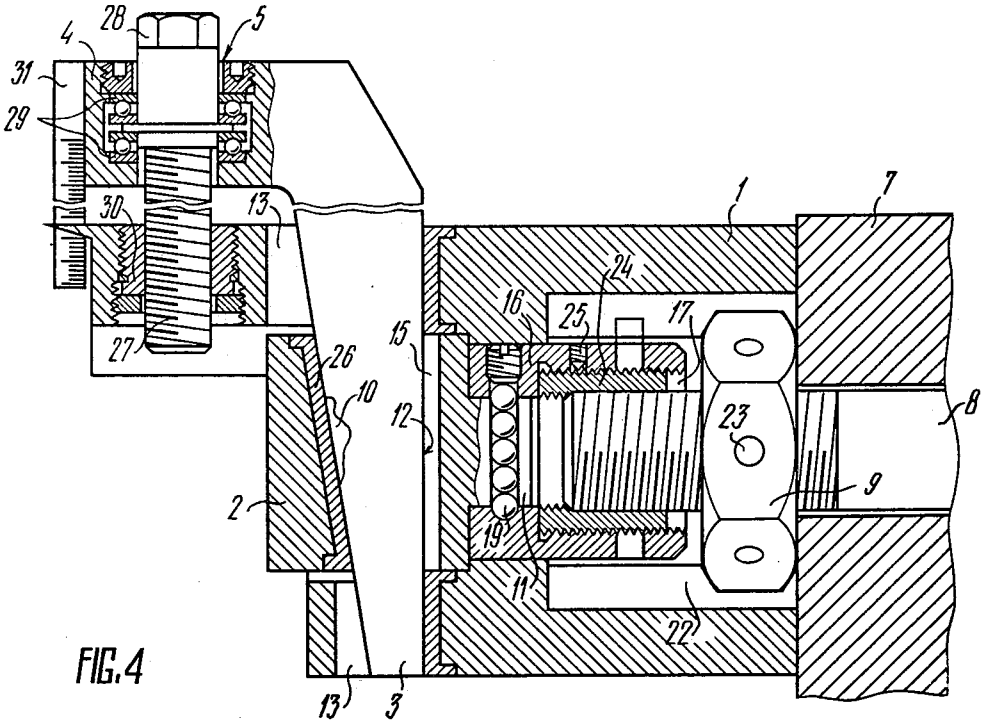
FIG. 4 shows the device illustrated in FIG. 1 with a sleeve member accommodated inside a connecting piece.
Figure 6:
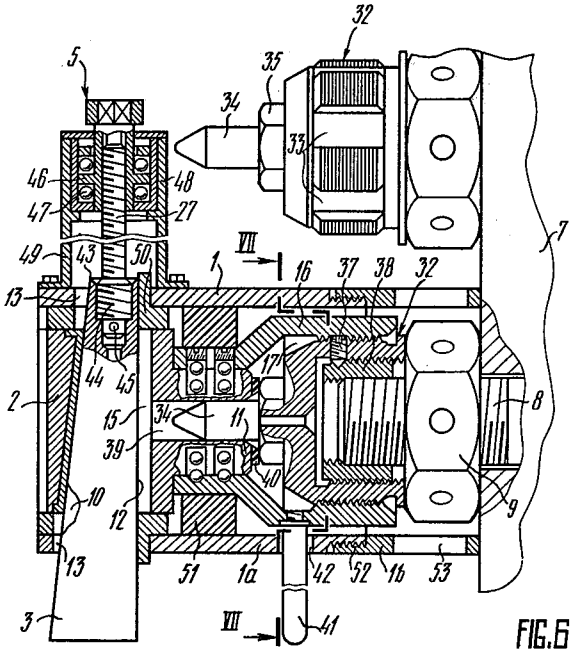
FIG. 6 is a section on the line VI—VI of FIG. 5.

The device according to the invention as shown with reference to FIGS. 5 and 6 and operated in conjunction with the intermediate sleeves 32, viz. two or three of such sleeves, is structurally similar to the embodiment thereof illustrated in FIGS. 1 and 4, i.e. it is provided with a pressure element 1 in the form of a body accommodating the tension element 2 and the connecting piece 16. Accordingly, in the pressure element 1 there is mounted the screw drive 5, the screw 27 of which cooperates with the power wedge 3 passing through the wedge groove 10 of the tension element 2 and the through grooves 13 of the pressure element 1.

However, in this modification the axial threaded portion 17 of the connecting piece 16 is of a diameter essentially larger than that of the stud piece 8 of the connection so as to accommodate therein the intermediate sleeve 32. The intermediate sleeve 32 (FIG. 6) is fashioned as a tubular member threaded on the inside and having elements 33, viz. projections and recesses, of a bayonet joint (a threaded version thereof) on the outside. End portion of the sleeve 32 is provided with an axial cylindrical end piece 34 tapered at the end and a projection or head 35, such as a hexahedral head, to fit a wrench, whereby screwing of the intermediate sleeves 32 onto the end of the stud piece 8 is effected.

Screwed into the inside of the intermediate sleeve 32 end stopped or fixed therein by a set screw 37 is a replaceable threaded sleeve member 38 indentical in design and intention to the sleeve 24 (FIG. 4) to fit the stud pieces 8 of various diameters. Alternatively, a modified form of the herein proposed device is possible, wherein the intermediate sleeve 32 is secured onto the end of the stud piece 8 without the use of such a replaceable sleeve (not shown).

For operatively inserting and fixing the intermediate sleeve 32 (FIG. 6) inside the device an axial bore 39 is provided in the connecting piece 16 of the tension element 2, said bore being intended to receive the end piece 34 of the intermediate sleeve 32, while the inner surface of the connecting piece 16 has bayonet joint elements adapted to fit between the elements 33 of the bayonet joint of the intermediate sleeve 32. Alternatively, a dog type bayonet coupling may be employed. The end face of the shank 11 of the tension element 2 is provided with a rubber washer 40 serving as a cushion during inserting the intermediate sleeve into the connecting piece 16. For turning the connecting piece 16 a certain angle to thereby completely lock it with the intermediate sleeve 32, the connecting piece 16 is provided with a lever 41 passing through a window or aperture 42 arranged in the pressure element 1.

According to this preferred embodiment of the device, the screw bolt 27 of the screw drive 5 is positioned along the axis of the power wedge 3 essentially in parallel with the straight working surface 12 thereof and secured in an end 43 of the smaller side of the wedge 3 by means of a threaded connection 44 and a pin 45.

Turning of the screw bolt 27 is effected by means of a ratchet bar (not shown), a nut 46 and thrust bearings 47. The nut 46 and bearings 47 are disposed inside a housing 48 affixed to the pressure element 1 by a bracket 49.

Interposed between the pressure element 1 and the tension element 2 in the area adjoining the power wedge 3 are inserts 50, whereas positioned between the connecting piece 16 and the pressure element 1 is a ring member 51 of a resilient material such as rubber, the ring 51 serving as a guide for the connecting piece 16.

Figure 3:
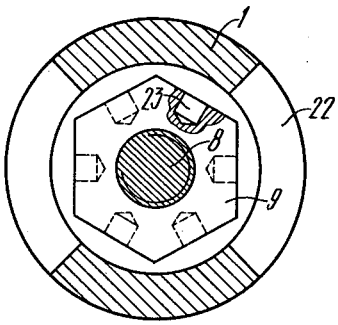
FIG. 3 is a section on the line III—III of FIG. 1.
Figure 7:
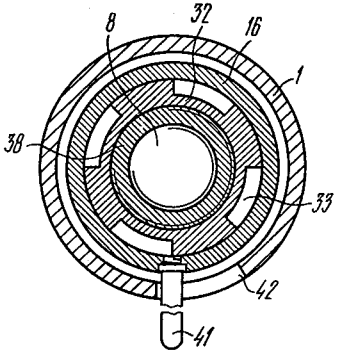
FIG. 7 is a section on the line VII—VII of FIG. 6.

In order to ensure a constant contact between the inclined surfaces of the power wedge and tension element during mounting the device on the stud piece 8, the pressure element 1 is made up of two parts 1*a* and 1*b* connected therebetween by a threaded arrangement 52. The part 1*a* is provided with a window or aperture 42 (FIG. 7) to accommodate the lever 41 of the connecting piece 16, while the part 1*b* has apertures 53 (FIG. 6) to provide an easy access to the nut 9, the apertures 53 being similar to the apertures 22 (FIG. 3). After the device has been mounted on the intermediate sleeve 32 (FIG. 6) followed by locking the bayonet joint, the part 1*b* of the pressure element 1 is turned to achieve a complete contact with the surface of the connectable piece 7. Tools similar to those used for rotating the nut 9, such as a top wrench, can be employed for turning the part 1*b* of the pressure element.

With reference to FIGS. 8 and 9, the part 1*b* of the pressure element 1 is provided with a spherical abutment 54, the center or radius R of the sphere being disposed on the center line of the connecting piece 16 and the stud piece 8. The spherical abutment 54 is connected with the part 1*b* of the pressure element 1 via a resilient gasket or spacer 55 (FIG. 9) adapted to be held in position as shown in FIG. 9 or in any other suitable manner, which helps prevent an adverse effect of possible skewness or misalignment if the axis of the stud piece 8 is curved or bent.

In order to reduce the friction coefficient, the surfaces of the inserts 26 (FIG. 8) cooperating with the surfaces of the power wedge 3 are defined by needle rollers 56. For the purpose of simplifying the manufacturing technique, the wedge groove 10 of the tension element 2 is defined by an inclined insert of the tension element and the insert 26 having a tapering configuration as illustrated in FIG. 8 and providing a contact with the wedge 3. The inclined surface of the insert 26 defined by the needle rollers 56 is adapted to provide contact with the inclined surface of the power wedge 3. Therewith, to ensure a constant cooperation between the surfaces of the inserts 26 and those of the power wedge 3, the pressure element 1 is provided with a spring 57, e.g. flat or coil spring, acting towards the wedge. A free end of the spring 57 is in permanent contact with the tension element 2 resulting in that the tension element 2 is spring-urged against the power wedge 3.

For reducing the overall dimensions of the device the screw bolt 27 of the screw drive 5 is disposed, as best seen in FIG. 8, inside the power wedge 3.

Arranged in parallel with the straight working surface 12 of the power wedge 3 is a through bore 58 accommodating the screw 27 of the screw drive 5. End of the screw 27 protruding from the bore 58 is enclosed by a thrust assembly or bearing 59 placed in a housing 60 secured to the pressure element 1, the thrust assembly 59 being arranged in the housing 60 to rest on a self-adjusting center plate 61.

The screw bolt 27 is provided with a ball bearing screw nut of any conventional design incorporating a spiral groove 62 arranged on the screw 27, a return groove 63 in the power wedge 3, and balls 64 accommodated both in the spiral and return grooves. The ball bearing screw nut including the return groove 63 may be arranged in a separate casing to be placed in the power wedge (not shown).

The device according to the invention operates as follows.

The nut 9 (FIG. 1) of the threaded connection, e.g. a flange connection, is manually screwed onto the threaded stud-piece 8 of this connection such that the end portion of the stud 8 protrudes from the nut 9. The device is then mounted so as to have the nut 9 and the end of the stud piece 8 enclosed by the pressure element 1 thereof. A wrench 65 or a tap wrench is inserted into the drilling 21 of the connecting piece 16 through the aperture 22 of the pressure element, whereby the connecting piece 16 is caused to rotate to be screwed onto the end of the stud piece 8. If the inner diameter of the connecting piece 16 does not correspond to the diameter of the stud piece 8, the connecting piece is then supplied with the sleeve 24 (FIG. 4) to be screwed thereinto which is then together with the connecting piece 16 threadingly secured on the end of the stud piece 8. The power wedge 3 is partially retracted from the wedge groove of the tension element by rotating the screw bolt 27 so that the gap or clearance 15 be formed between the straight surfaces 12 of the power wedge 3 and those of the groove 10. Thereafter, provided care has been taken that the connecting piece 16 either with or without the sleeve member 24 is securely fastened to the end of the stud piece 8, the power wedge 3 is forced into the wedge groove 10 of the tension element 2 by turning the screw bolt 27. Therewith, straining of the stud piece 8 is effected by the power wedge 3 acting to thrust against the inclined surface of the groove 10 of the tension element 2 via the shank 11, connecting piece 16 and sleeve member 24. By the straight working surface 12 the power wedge 3 acts on the pressure element 1 thereby preventing the connectable flange or piece 7 whereagainst the pressure element is caused to bear from being offset.

The screw bolt 27 is further rotated until the strain gauge 31 indicates a required axial load exerted longitudinally of the stud piece 8, the strain gauge having been calibrated prior to the above operation. Thereupon, final tightening of the nut 9 of the threaded connection is to be carried out through the aperture 22 of the pressure element. If necessary, the tightening operation can be repeated. After one stud piece has been tightened, the connecting piece 16 and the sleeve 24 are removed from the stud piece 8 to be mounted on the next threaded connection to be tightened.

When several intermediate sleeves 32 (FIGS. 6 and 8) are employed, operation of the device is started after the intermediate sleeves 32 have been screwed onto a number of threaded stud pieces of the connection to be tightened. Thereafter, the connecting piece 16 of the device is mounted on one of such intermediate sleeves and turned by the lever 41 until full locking of the elements 33 of the bayonet connection is attained. The tightening is effected as described hereinbefore. After the threaded connection has been tightened, the lever 41 is turned in the opposite direction to thereby disengage the bayonet joint of the connecting piece 16 with the intermediate sleeve 32. The device is then removed and the intermediate sleeve 32 unscrewed from the tightened stud to be reinstalled on the next stud to be tightened, whereafter the process is recommenced until all the studs of the connection are tightened.

To displace the power wedge 3, the screw bolt 27 can be turned by a wrench 66 (FIG. 5) provided with a ratchet device or a reducing gear with a lever. Since in most of the flange connections, such as those associated with high pressure vessels, copper or soft steel gaskets are generally used, the extent of compression of the gaskets and consequently the value of the stud strain are negligible, viz. from 1 to 3 mm at the most. This will result in that the working stroke of the power wedge will lie within between 20 to 40 mm, the wedge tapering angle ranging from 1° to 5°.

INDUSTRIAL APPLICABILITY

The device according to the invention can find application in tightening coarse threaded connections; however, it can as well be used for pressing in (or out) of bearings, sleeves, etc.

We claim:

1. A device for tightening a connection member extending between and interconnecting two connectable pieces, said connection member having a threaded member protruding from an opening in one of the connectable pieces, said device comprising a pressure element positionable so as to thrust against said one of the connectable pieces, a tension element positionable on the threaded member and having a wedge groove, a power wedge accommodated in the wedge groove and acting against the pressure element thereby producing tension in the threaded member, a screw drive for the power wedge disposed on the presure element, the pressure element being in the form of a hollow body provided with through grooves arranged coaxially with the wedge groove and accommodating the tension element, the tension element carrying an axially rotatable connecting piece having an axial threaded bore for fixing the connecting piece on the threaded member, the pressure element being provided in an area adjoining the connecting piece with apertures, walls of the through grooves arranged coaxially with the wedge groove of the tension element defining a guide receiving a straight working surface of the power wedge.

2. A device as claimed in claim 1, characterized in that the axial threaded bore of the connecting piece accommodates a replaceable threaded sleeve member, an outer surface of the connecting piece being provided with drillings for facilitating rotation of the connecting piece.

3. A device as claimed in claim 1, characterized in that it is further provided with at least one intermediate sleeve placed, after having been screwed onto the threaded member, in the axial bore of the connecting piece of the tension element and secured therein by means of a bayonet joint, the intermediate sleeve having a cylindrically shaped axial end piece and a projection rotatable by a wrench, the connecting piece of the tension element having an axial bore to receive the end piece of the intermediate sleeve and a lever passing through an aperture of the pressure element.

4. A device as claimed in one of claims 1 to 3, characterized in that inserts engageable by the power wedge are accommodated in the wedge groove of the tension element and in the through grooves of the pressure element arranged coaxially relative to the wedge groove.

5. A device as claimed in one of claims 1 to 3, characterized in that the pressure element is made up of two parts interconnected by a threaded connection.

6. A device as claimed in claim 5, characterized in that one of the parts of the pressure element is adapted to be thrust against one of the connectable pieces and provided with a spherical abutment, the center of the sphere thereof being disposed on the center line of the connecting piece and the center line of the threaded member.

7. A device as claimed in claim 6, characterized in that the spherical abutment is joined to the pressure element via a resilient spacer.

8. A device for applying tension to a threaded stud piece, the stud piece being used to interconnect two connectable pieces and having a threaded end portion protruding from one of the connectable pieces, said device comprising:

a pressure element having an open end, an axially-extending hollow portion extending inwardly from the open end, and a wedge receiving groove formed in an end portion of said pressure element opposite said open end and extending transversely to the axis of the hollow portion, the open end of the pressure element being positionable adjacent a surface of one of the connectable pieces so that the threaded end portion of the stud piece is received in the hollow portion of said pressure element;

a tension element having a connecting piece extending into the hollow portion engageable with the threaded end portion of the stud piece, and a wedge groove alignable with the wedge receiving groove of said pressure element;

a power wedge positionable in said wedge groove and said wedge receiving groove so that movement of said power wedge in a given direction urges said tension element away from the threaded end portion of the stud piece thereby applying tension to said threaded stud; and means carried by said pressure element for moving said power wedge in said given direction.

9. A device according to claim 8, wherein a nut is positionable on said threaded end portion between said surface of said one of the connectable pieces and said connecting piece, said pressure element having an aperture formed therein providing access to said nut so that the nut is movable into contact with said surface after tension has been applied to said threaded stud piece, said connecting piece being removable from said threaded end portion after contact between said nut and said surface.

10. A device according to claim 8 or 9, further comprising an intermediate sleeve having an inner surface engageable with the threaded end portion of the stud piece and an outer surface engageable with said connecting piece, the outer surface of the intermediate sleeve and the connecting piece carrying complementary fastening elements so that the connecting piece is locked to the intermediate sleeve by relative rotation between said intermediate sleeve and said connecting piece.

11. A device according to claim 8, wherein said pressure element comprises a first part, a second part, and means for interconnecting said first part and said second part, said first part supporting said tension element and said second part being movable with respect to said first part after said connecting piece engages said threaded end portion so that an end of said second part comes into contact with said surface of said one of said connectable pieces.

12. A device for tightening coarse thread connections formed in openings of two connectable pieces comprising:

a threaded part positionable in openings of two connectable pieces and having a free end projecting from one of the connectable pieces;

a nut screwed onto the free end of said threaded part so that a portion of the free end protrudes from the nut;

a pressure element having a hollow body and resting on the one of the connectable pieces and receiving said free end of said threaded part;

a tension element with a wedge groove located in the hollow body of said pressure element and fastened to the portion of the free end of the threaded part protruding from the nut;

a power wedge with a screw drive positioned in the wedge groove of said tension element for acting upon said pressure element to produce tensioning of the threaded part, a shank portion of said tension element being positioned in the hollow body of the pressure element;

a connecting piece mounted for rotation about its axis on said shrank portion, drillings being provided on an outer surface of said connecting piece, and an axial threaded bore formed in said connecting piece and adapted for screwing said connecting piece onto the portion of said end of the threaded part protruding from the nut;

apertures provided in said pressure element opposite the portion of said connecting piece located at the end of the threaded part; and through bores provided in said pressure element in alignment with said wedge groove so that walls of said pressure element forming said through bores define a guide for a working surface of the power wedge.

13. A device as claimed in claim 12, further comprising a replaceable threaded sleeve member screwed into said threaded bore of the connecting piece for securing the connecting piece at the protruding portion of the end of the threaded part.

14. A device as claimed in claim 13, wherein a bore is provided in said shank portion of the tension element for accommodating balls therein, said device further comprising balls positioned in said bore for connecting said connecting piece to said shank portion of the tension element.

15. A device as claimed in claim 13, further comprising an intermediate sleeve engaged with the portion of the threaded part protruding from the nut, said intermediate sleeve being received in said axial threaded bore of the connecting piece; a bayonet joint effecting coupling of the connected piece with the intermediate sleeve; a cylindrical axial end piece having a projection to fit a wrench which has said intermediate sleeve; an axial bore provided in the connecting piece and adapted to accommodate an end piece of the intermediate sleeve; and a lever mounted on the connecting piece and passing through one of the apertures of the pressure element.

16. A device as claimed in claim 13, wherein the pressure element is formed by two parts interconnected by a thread joint, a portion of the pressure element thrusting against one of the connectable pieces being provided with a spherical abutment, the center of the abutment being disposed on the center line of the connecting piece and of the threaded piece, said device further comprising a resilient spacer, the abutment being joined to the pressure element via the resilient spacer.

* * * * *